US009863178B2

(12) United States Patent
Wang et al.

(10) Patent No.: US 9,863,178 B2
(45) Date of Patent: Jan. 9, 2018

(54) TWO-WAY SOFT CLOSING DEVICE FOR A SLIDING DOOR AND SOFT CLOSING ACTIVATION TRIGGER ASSEMBLY THEREOF

(71) Applicant: Weider Metal Inc., New Taipei (TW)

(72) Inventors: Grace Show-Yin Wang, New Taipei (TW); Jennifer Wu, New Taipei (TW); Andy Wu, New Taipei (TW); Jacqueline Wu, New Taipei (TW)

(73) Assignee: Weider Metal Inc., New Taipei (TW)

( * ) Notice: Subject to any disclaimer, the term of this patent is extended or adjusted under 35 U.S.C. 154(b) by 0 days.

(21) Appl. No.: 15/092,653

(22) Filed: Apr. 7, 2016

(65) Prior Publication Data

US 2017/0051548 A1 Feb. 23, 2017

(30) Foreign Application Priority Data

Aug. 21, 2015 (TW) ..... 104127264 A
Aug. 21, 2015 (TW) ..... 104127265 A

(51) Int. Cl.
*E05D 13/00* (2006.01)
*E05F 5/02* (2006.01)
(Continued)

(52) U.S. Cl.
CPC ..... *E05F 5/02* (2013.01); *E05F 5/003* (2013.01); *E05F 5/027* (2013.01); *E06B 3/4636* (2013.01); *E05Y 2900/132* (2013.01)

(58) Field of Classification Search
CPC .. E05F 5/02; E05F 5/027; E05F 5/003; E06B 3/4636
See application file for complete search history.

(56) References Cited

U.S. PATENT DOCUMENTS 5,302,016 A * 4/1994 Lautenschlager .... A47B 88/467 292/71
8,235,478 B2 * 8/2012 Zimmer ..... A47B 88/467 312/319.1

(Continued)

FOREIGN PATENT DOCUMENTS

TW M401685 4/2011
TW M410784 U 9/2011

(Continued)

*Primary Examiner* — Jerry Redman
(74) *Attorney, Agent, or Firm* — Alan D. Kamrath; Kamrath IP Lawfirm, P.A.

(57) ABSTRACT

A two-way soft closing device is mounted in a sliding door and has a sliding door track, two soft closing activation triggers, two roller carriers and a soft closing device. The sliding door track is an elongated member. The soft closing activation triggers are mounted movably in two ends of the sliding door track respectively. The roller carriers are mounted slidably in the sliding door track and are spaced apart at an interval. The soft closing device is mounted in the sliding door track, is located between the roller carriers and is mounted firmly in one of the roller carriers. Therefore, the soft closing device absorbs a collision between a sliding door plate and a doorframe when the sliding door is opened or is closed. Meanwhile, the two-way soft closing device eliminates noise coming from the collision and prevents an elder or a little child from being hit by the sliding door plate.

19 Claims, 11 Drawing Sheets

(51) Int. Cl.
*E05F 5/00* (2017.01)
*E06B 3/46* (2006.01)

(56) References Cited

U.S. PATENT DOCUMENTS 8,272,166 B2 * 9/2012 Nezu ..... E05B 65/0858 49/358
8,714,671 B2 * 5/2014 Huang ..... A47B 88/467 312/319.2
8,931,138 B2 * 1/2015 Shimizu ..... E05F 1/16 16/49
2010/0026152 A1 * 2/2010 Huang ..... A47B 88/463 312/319.1
2011/0023370 A1 * 2/2011 Zimmer ..... E05F 1/16 49/360
2011/0067313 A1 * 3/2011 Walhorn ..... E05F 1/16 49/360
2011/0167588 A1 * 7/2011 Chang ..... E05F 5/003 16/71
2011/0271482 A1 * 11/2011 Nezu ..... E05F 1/16 16/49
2013/0019438 A1 * 1/2013 Tanno ..... E05F 1/16 16/94 R
2014/0026357 A1 * 1/2014 Zimmer ..... E05F 1/16 16/72
2014/0109343 A1 * 4/2014 Chang ..... E05F 5/003 16/49
2016/0040465 A1 2/2016 Wang et al.

FOREIGN PATENT DOCUMENTS

TW M443756 U 12/2012
TW I432638 B 4/2014
TW M516087 U 1/2016
TW M516640 2/2016

* cited by examiner

TWO-WAY SOFT CLOSING DEVICE FOR A SLIDING DOOR AND SOFT CLOSING ACTIVATION TRIGGER ASSEMBLY THEREOF

BACKGROUND OF THE INVENTION

1. Field of the Invention

The present invention relates to a two-way soft closing device and a soft closing activation trigger assembly of the two-way soft closing device and, more particularly, to a two-way soft closing device for a sliding door that absorbs a collision incurred between a sliding door panel and a doorframe during a door-opening or a door-closing action. The two-way soft closing device eliminates noise coming from a door panel collision and prevents fingers of elders or children from being trapped or prevents accidents caused by a sliding door edge coming to a direct collision without any reduction of speed. The soft closing activation trigger assembly that is easily adjusted eliminates a door panel closing gap as well as allows users to adjust the closing distance according to their door opening and closing requirements. Furthermore, the present invention eliminates a malfunction that results from the soft closing activation trigger assembly becoming broken or loosened by colliding with the triggers at a high speed. Then, the present invention avoids the soft closing activation trigger assembly skidding with the sliding door, and prevents users from accidents caused by the door panel in a high speed sliding.

2. Description of the Related Art

A sliding door is usually mounted in an exit of a building or used for an internal building partitioning. The sliding door moves laterally along a sliding door track to open or to close an internal partitioning opening. The sliding door track has a soft closing device and a soft closing activation trigger. The length of the sliding door track is fitted in proportion to the width of the partitioning opening. The sliding door track is an elongated member and mounted in a top end of the opening. The soft closing device is mounted within the sliding door track. The sliding door is connected to the soft closing device. When a user pushes or pulls the sliding door to move towards a door-opening position or a door-closing position, the soft closing device moderates a moving speed of the sliding door with a soft closing cylinder which is activated by the soft closing activation trigger. Therefore, the soft closing device prevents the sliding door from moving too fast. The siding door in motion may cause the door panel to collide with a doorframe, which causes a collision noise, panels shattering and accidents. The sliding door at high speed may collide with elders or children.

However, a conventional soft closing device emphasizes a single-sided soft closing function to prevent one side of the door panel from colliding to the doorframe directly. Mounted in the interior ceiling or wall, the conventional soft closing device is affected by the perpendicular alignment of the interior ceiling. The non-perpendicular alignment of the ceiling or wall makes the sliding door track to be mounted improperly. The improper mounting of the sliding door track causes abrasions between the track and wheels, and makes a difficult maneuvering of the door panel. As mentioned above, the inconsistency in the construction site will increase the resilience of the soft-closing spring. The soft-closing spring maneuvers the door panel back to a pre-set closing position. The increasing resilience of the soft-closing spring causes a gap formed between the door panel and the wall. The soft closing device is usually disposed to the door-closing direction to cushion the door panel. The soft closing device maneuvers the door panel to move towards the closing position. Furthermore, since the conventional soft closing devices cannot adjust a latching range that is a distance between the locations of the trigger and the doorframe, the conventional soft closing device does not allow users or interior designers to adjust the soft closing distance as their requirements. The latching range affects whether the door panel closes in the doorframe. Besides, the interior designer adjusts the location of the sliding door panel, which makes the edge of the sliding door panel to outstand from a fixed doorframe. The user could easily grasp the sliding door panel to close. Furthermore, when the user pulls the door panel to open the sliding door, the soft closing activation trigger stretches a spring that is mounted in the soft closing device. Usually, the user has to exert a heavy effort to overcome a resilience of the spring to move the door panel. If the user exerts an excessive force, the door panel would directly hit the doorframe at a high speed, which results in a colliding noise and which damages the soft closing device, the door panel, and the doorframe. If the force exerted from the user is excessively small, the door panel would not be moved or would not trigger any soft closing action.

For solving the above-mentioned problems, a manufacturer could assemble two units of single-sided soft closing devices that have the same structures and in opposite mounting directions in the sliding door. One of the single-sided soft closing devices is mounted in the door-closing direction. The other single-sided soft closing device is mounted in a door-opening direction. However, assembling the two single-sided soft closing devices increases installing time and complexity of installation as well as production cost. Thus, selecting and using two single-sided soft closing devices creates a major hassle for end users.

When the conventional sliding door is closed, a gap is formed between the door plate and the doorframe. Since a conventional trigger has a pre-set fixed travelling distance and a triggering distance on the soft closing device, the gap cannot be eliminated. Therefore, even when the user considers a door panel is variable size and weight, and once the door panel is mounted in an installation site of a doorframe, the gap is formed due to the door panel structural tolerances, doorframe tolerances, construction site inconsistencies and imperfectness of site conditions. The gap causes trouble and malfunction on the use of the sliding door.

Another conventional trigger is mounted in a rib of the sliding door track with two mounting plates. The mounting plates abut a top surface and a bottom surface of the rib respectively. The mounting plates are connected with a bolt. When the user adjusts a location of the trigger relative to the sliding door track, the bolt is loosened to move the mounting plates. However, the loosening degree of the bolt is not easy to control. The bolt may be removed from one mounting plate that abuts the top surface of the rib, and, then, the other mounting plate that abuts the bottom surface of the rib would drop and hit the user.

When the soft closing device of the conventional sliding door needs to be repaired, the whole sliding door track must be removed along with the soft closing device to repair or to replace components. Nevertheless, the length of the sliding door track is over 2 meters, so detaching or mounting the sliding door track is not easy. The repair of the soft closing device increases a working time and repairing cost for the end user. Also, repairing of the soft closing device further damages the interior decoration of the building.

SUMMARY OF THE INVENTION

An objective of the present invention is to provide a two-way soft closing device and a soft closing activation trigger assembly of the two-way soft closing device and, more particularly, to provide a two-way soft closing device mounted in a sliding door that absorbs a collision which is incurred between a sliding door panel and a doorframe in a door-opening or door-closing scenario, that eliminates noise coming from the collision, and that prevents an elder or a little child from direct contact by the fast moving sliding door panel. A soft closing activation trigger is easily adjusted to eliminate a gap and prevents a user from injury from the soft closing activation trigger falling.

To achieve the foregoing objective, the two-way soft closing device in accordance with the present invention comprises a sliding door track, two soft closing activation triggers, two roller carriers and a soft closing assembly. The sliding door track is an elongated member and has a top plate, two side plates, a slot, two mounting parts and two supporting parts. The side plates protrude from two sides of a bottom surface of the top plate. The slot is formed longitudinally in a bottom surface of the sliding door track and is located between the side plates. The mounting parts are connected to each other. Each mounting part protrudes from a top end of a side surface of the side plate. The supporting parts are connected to each other. Each supporting part protrudes from a bottom end of the side surface of the side plate. The soft closing activation triggers are mounted movably between the mounting parts and are mounted in two ends of the sliding door track respectively, and each soft closing activation trigger has an abutting part that protrudes from the soft closing activation trigger. The roller carriers are mounted in the sliding door track, are spaced apart at an interval, are mounted through the slot and are mounted slidably in the supporting parts. The soft closing assembly is mounted in the sliding door track, is located between the roller carriers, is mounted firmly in one of the roller carriers and has a damper, two sliding bases, a spring, two tracking assemblies and two side frames. The sliding bases are mounted rotatably in the two ends of the damper, and each sliding base has an extending part, an embedding groove and multiple stubs. The extending part is formed in a top end of the sliding base. The embedding groove is defined in the extending part and is mounted detachably around the abutting part. The stubs protrude symmetrically from two side surfaces of the sliding base respectively. Two ends of the spring are mounted in the sliding bases respectively. The tracking assemblies are disposed above the two ends of the damper, and each tracking assembly has two tracking plates, two guiding grooves and two positioning parts. The tracking plates are disposed towards the damper and the sliding base respectively and are connected to each other. Each tracking plate has an inner surface and an outer surface, and the inner surfaces of the tracking plates are connected to each other. The guiding grooves are mounted around the stubs of the sliding bases and are connected to each other. Each guiding groove is defined longitudinally in the inner surface of the tracking plate. The positioning parts are connected to each other. Each positioning part is defined in one of two ends of the tracking plate, communicates with the guiding groove, is curved, and is located away from the damper. The side frames are mounted in the tracking assemblies and are mounted in one of the roller carriers. Each side frame is mounted in the outer surface of the tracking plate.

Other objectives, advantages and novel features of the invention will become more apparent from the following detailed description when taken in conjunction with the accompanying drawings.

DETAILED DESCRIPTION OF THE INVENTION

Figure 1:
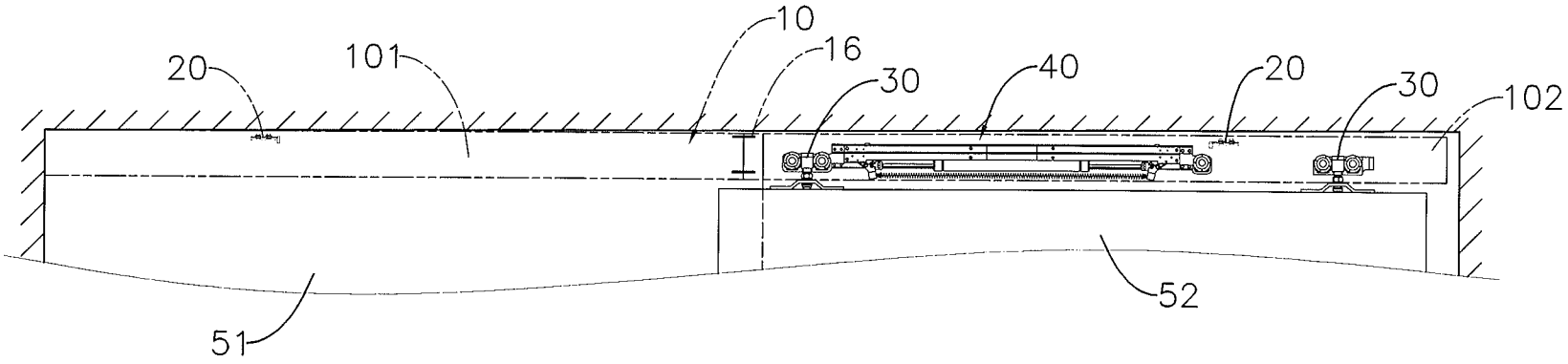
FIG. 1 is a front view of a two-way soft closing device mounted in a sliding door in accordance with the present invention.
Figure 2:
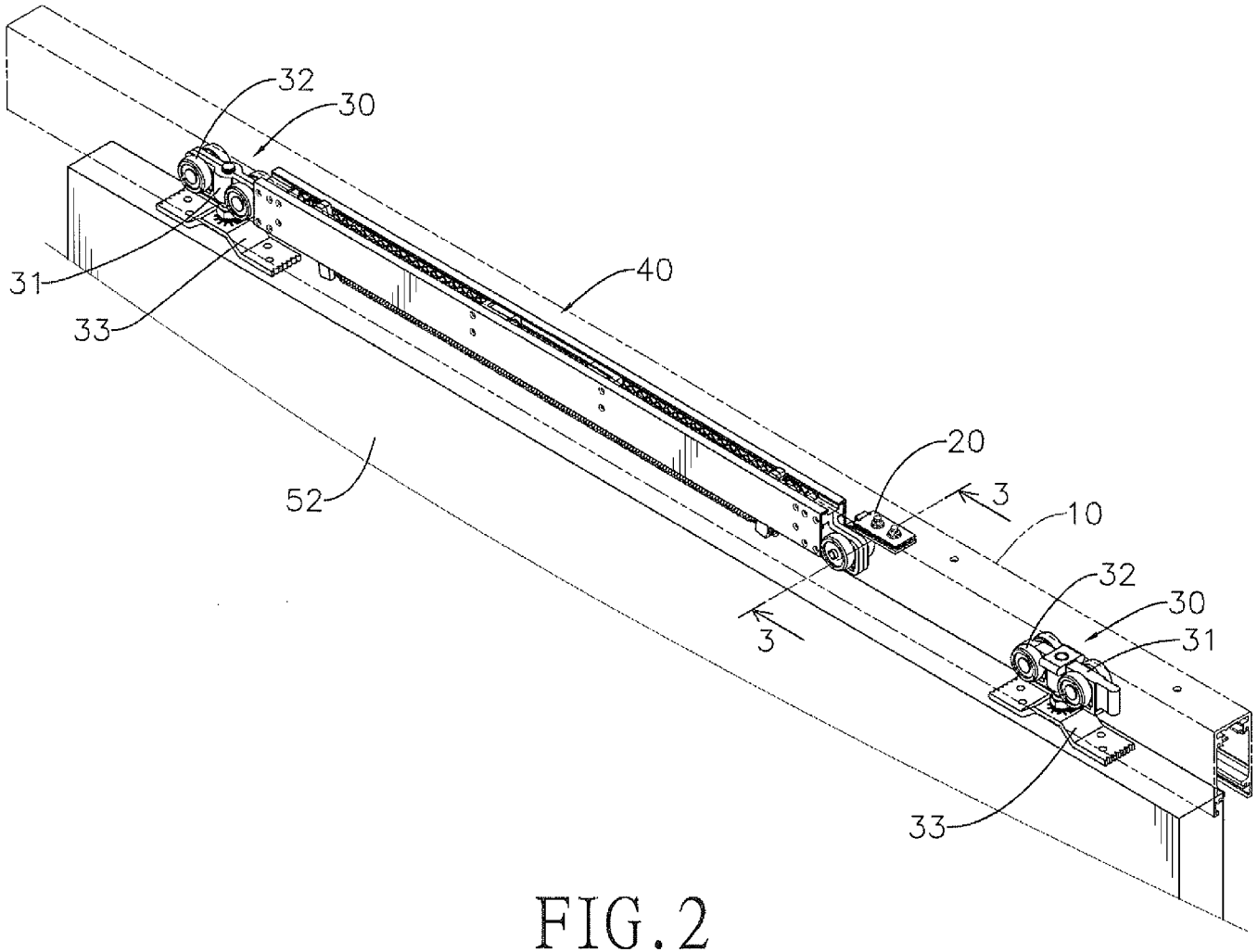
FIG. 2 is an enlarged perspective view of the two-way soft closing device in FIG.1.

With reference to FIGS. 1 and 2, a two-way soft closing device in accordance with the present invention has a soft closing activation trigger assembly, two roller carriers 30 and a soft closing assembly 40.

The soft closing activation trigger assembly has a sliding door track 10 and two soft closing activation triggers 20.

Figure 3:
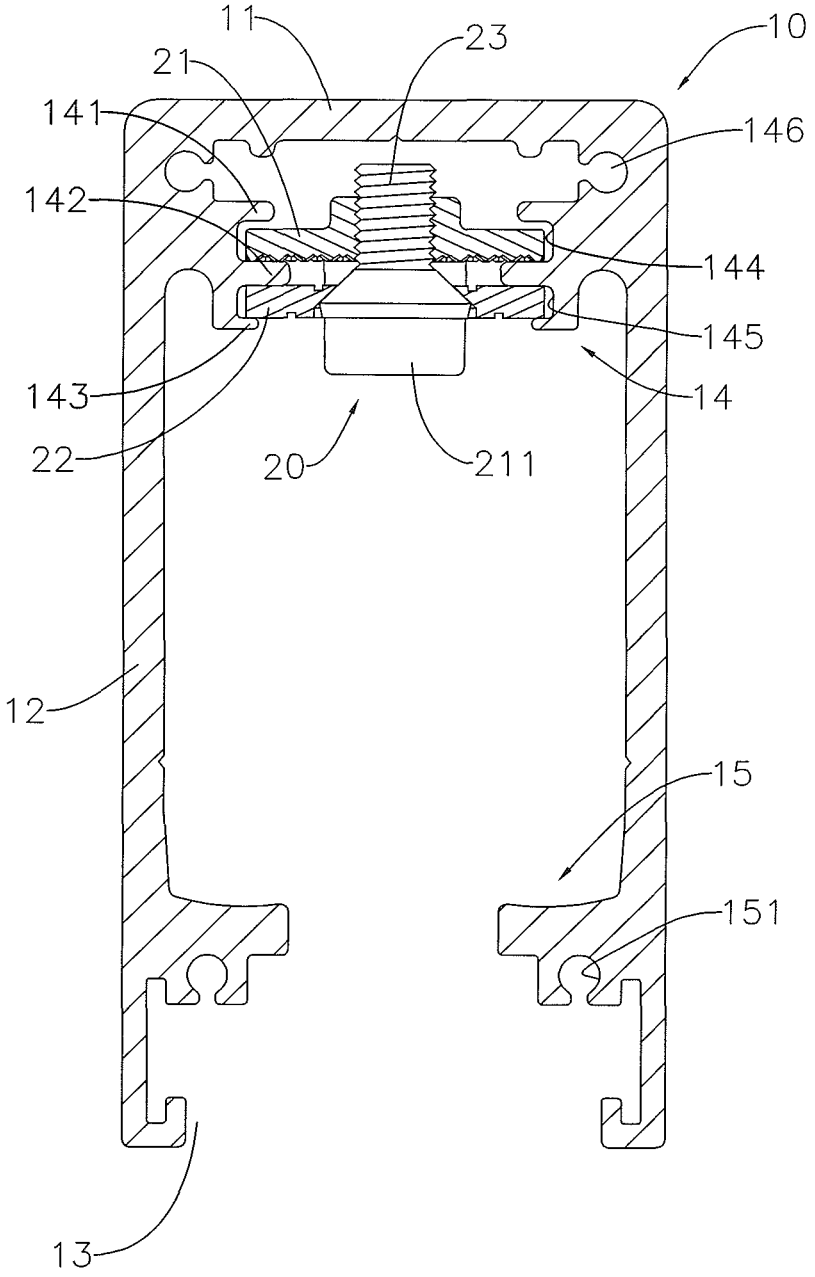
FIG. 3 is a cross sectional side view of a sliding door track and a soft closing activation trigger of the two-way soft closing device taken along line 3-3 in FIG. 2, with the soft closing assembly and the roller carrier omitted.

With reference to FIG. 3, the sliding door track 10 is an elongated member and has a top plate 11, two side plates 12, a slot 13, two mounting parts 14 and two supporting parts 15.

The side plates 12 protrude from two sides of a bottom surface of the top plate 11.

The slot 13 is formed longitudinally in a bottom surface of the sliding door track 10 and is located between the side plates 12.

The mounting parts 14 are disposed corresponding in position to each other. Each mounting part 14 protrudes from a top end of a side surface of the side plate 12 and has a top limiting rib 141, an abutting rib 142, a bottom limiting rib 143, a top mounting groove 144 and a bottom mounting groove 145.

The top limiting rib 141 protrudes from the side plate 12.

The abutting rib 142 protrudes from the side plate 12 and is disposed corresponding in position to the top limiting rib 141 at a spaced interval.

The bottom limiting rib 143 protrudes from the side plate 12 and is disposed corresponding in position to the abutting rib 142 at a spaced interval.

The top mounting groove 144 is formed between the top limiting rib 141 and the abutting rib 142.

The bottom mounting groove 145 is formed between the abutting rib 142 and the bottom limiting rib 143.

The supporting parts 15 are disposed corresponding in position to each other. Each supporting part 15 protrudes from a bottom end of the side surface of the side plate 12.

Figure 4:
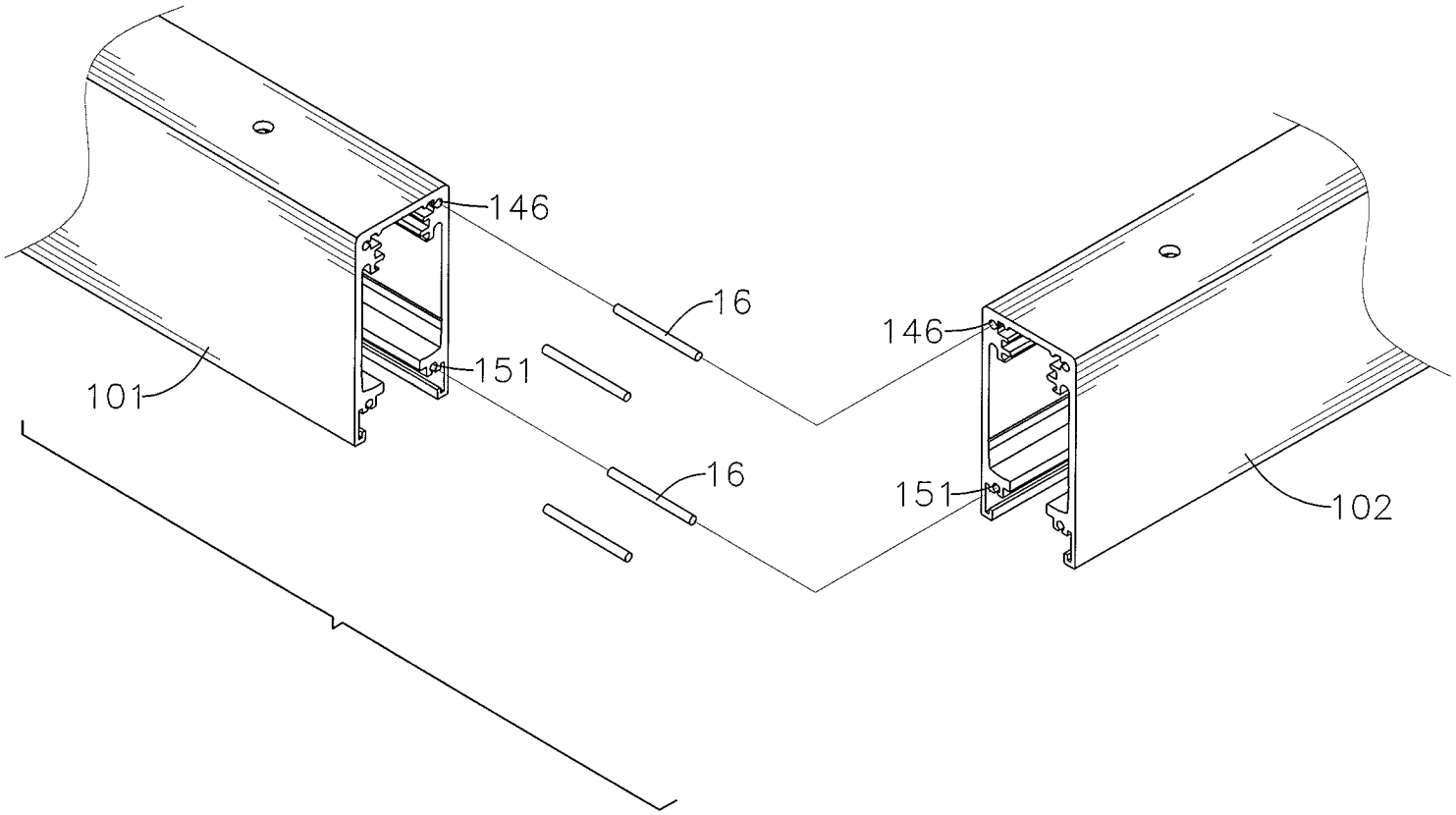
FIG. 4 is an enlarged exploded perspective view of the sliding door track of the two-way soft closing device in FIG. 1.

With reference to FIGS. 3 and 4, specifically, the sliding door track 10 may be divided into a main sub-track 101 and a maintenance sub-track 102 and further has four track integration pins 16. The main sub-track 101 is connected to the maintenance sub-track 102 with the four track integration pins 16.

The main sub-track 101 has the top plate 11, the side plates 12, the slot 13, the mounting parts 14 and the supporting parts 15. The mounting parts 14 protrude from the side plates 12 respectively. The supporting parts 15 protrude from the side plates 12 respectively. Each mounting part 14 further has a top inserting groove 146 that is defined longitudinally in the mounting part 14. Each supporting part 15 has a bottom inserting groove 151 that is defined longitudinally in the supporting part 15.

The maintenance sub-track 102 has the top plate 11, the side plates 12, the slot 13, the mounting parts 14 and the supporting parts 15. The mounting parts 14 protrude from the side plates 12 respectively. The supporting parts 15 protrude from the side plates 12 respectively. Each mounting part 14 has the top inserting groove 146. Each supporting part 15 has the bottom inserting groove 151.

The track integration pins 16 connect the main sub-track 101 to the maintenance sub-track 102 and are disposed in parallel to each other. Each track integration pin 16 has a first end and a second end. The first ends of the track integration pins 16 are mounted respectively in the top inserting grooves 146 and the bottom inserting grooves 151 of the main sub-track 101. The second ends of the track integration pins 16 are mounted respectively in the top inserting grooves 146 and the bottom inserting grooves 151 of the maintenance sub-track 102.

Figure 5:
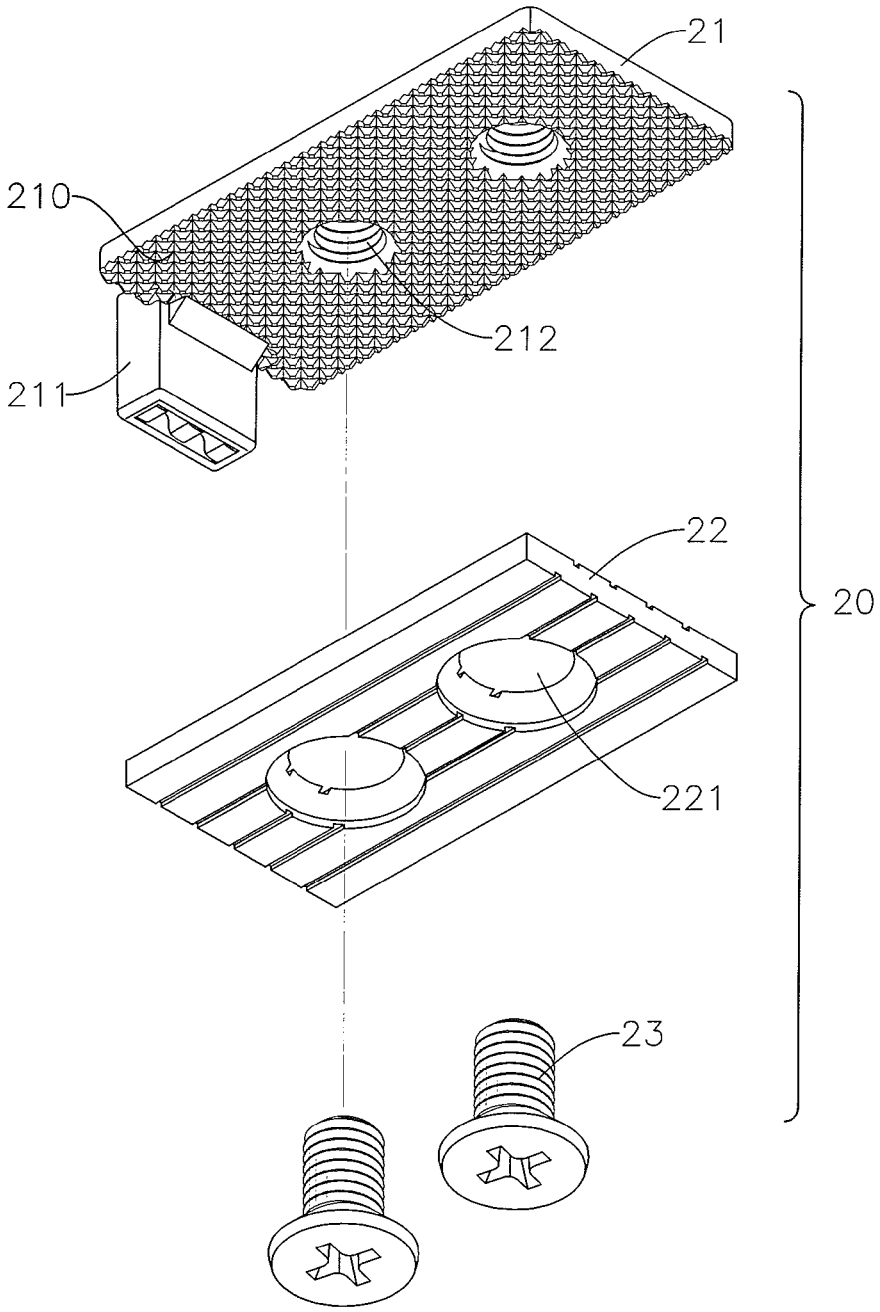
FIG. 5 is an exploded perspective view of the soft closing activation trigger of the two-way soft closing device in FIG. 2.

With reference to FIGS. 1, 3 and 5, the soft closing activation triggers 20 are mounted movably between the mounting parts 14 and are mounted in two ends of the sliding door track 10 respectively. Specifically, the soft closing activation triggers 20 are mounted in the main sub-track 101 and the maintenance sub-track 102 respectively. Each soft closing activation trigger 20 has a top mounting plate 21, a bottom mounting plate 22 and at least one connecting member 23.

Two sides of the top mounting plate 21 are mounted respectively in the top mounting grooves 144 of the mounting parts 14. The top mounting plate 21 abuts the abutting ribs 142 and has a rough part 210, an abutting part 211 and at least one connecting hole 212.

The rough part 210 is formed in a bottom surface of the top mounting plate 21 and abuts top surfaces of the abutting ribs 142. Specifically, the rough part 210 has multiple projections that protrude from the top mounting plate 21 and abut the abutting ribs 142.

The abutting part 211 protrudes from the bottom surface of the top mounting plate 21 and is located between the abutting ribs 142 of the mounting parts 14.

The at least one connecting hole 212 is defined through the top mounting plate 21.

Two sides of the bottom mounting plate 22 are mounted respectively in the bottom mounting grooves 145 of the mounting parts 14. The bottom mounting plate 22 abuts the abutting ribs 142 and has at least one through hole 221. A bottom surface of the bottom mounting plate 22 is extended over by the abutting part 211.

The at least one through hole 221 is defined through the bottom mounting plate 22 and corresponds in position to the at least one connecting hole 212 of the top mounting plate 21.

The protruding parts 222 protrude respectively from four corners of a top surface of the bottom mounting plate 22 and abut bottom surfaces of the abutting ribs 142.

The at least one connecting member 23 is mounted through the at least one through hole 221 of the bottom mounting plate 22 and is mounted in the at least one connecting hole 212 of the top mounting plate 21.

Figure 6:
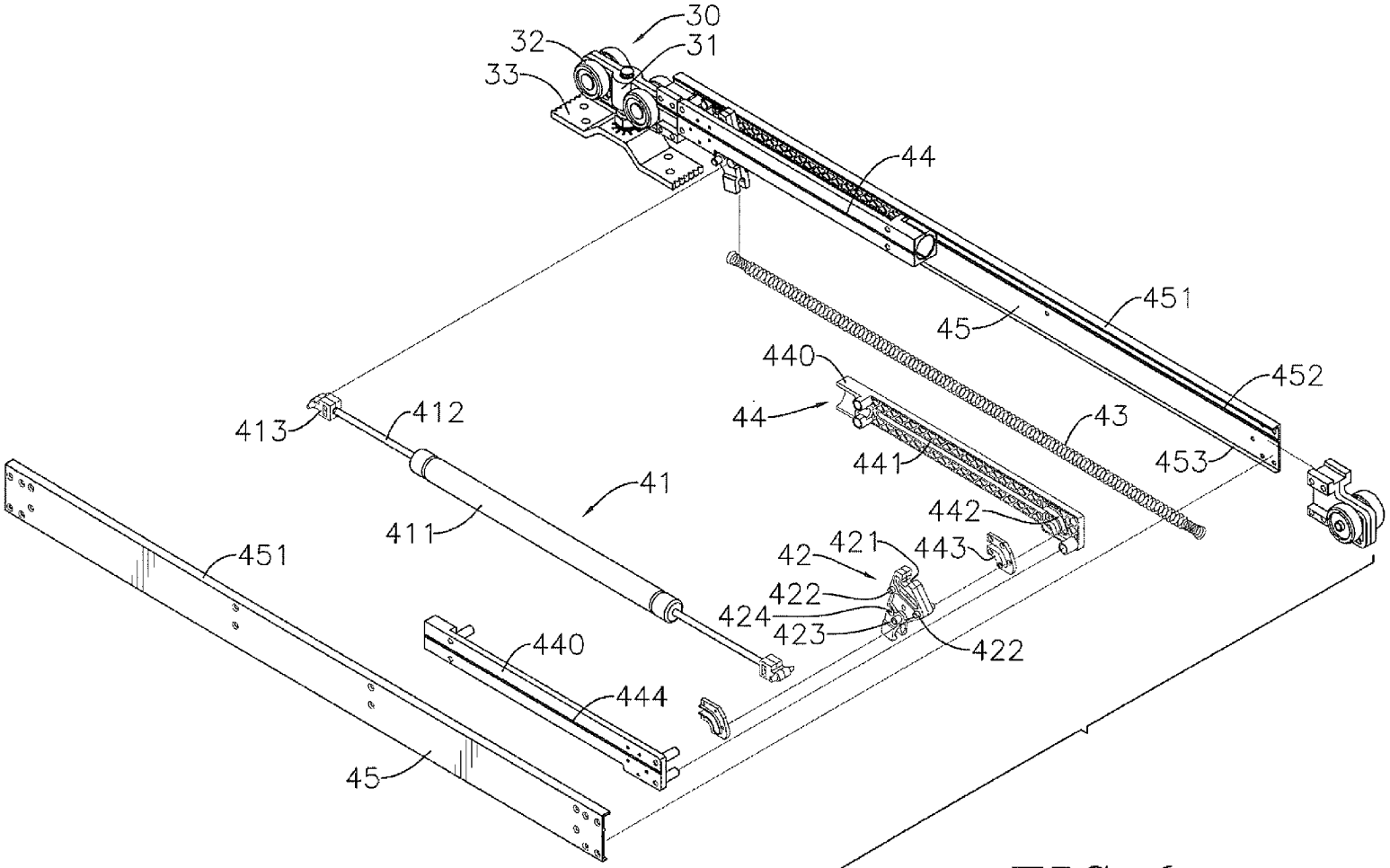
FIG. 6 is an exploded perspective view of a soft closing device of the two-way soft closing device in FIG. 2.

With reference to FIGS. 2, 3 and 6, the roller carriers 30 are mounted in the sliding door track 10, are spaced apart at an interval, are mounted through the slot 13, and are mounted slidably in the supporting parts 15. Each roller carrier has a base part 31, multiple rollers 32 and a hanger 33.

The hanger 33 extends out of the slot 13 of the sliding door track 10 and is mounted in a bottom of the base part 31.

Figure 7:
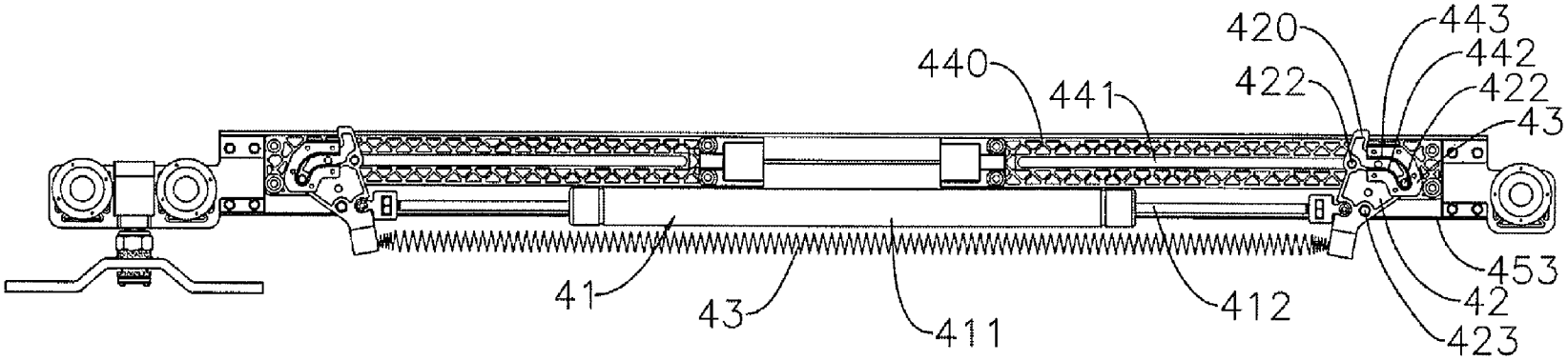
FIG. 7 is an enlarged front view of the soft closing device with partial elements in FIG. 6.

With reference to FIGS. 6 and 7, the soft closing assembly 40 is mounted in the sliding door track 10, is located between the roller carriers 30, is mounted firmly in one of the roller carriers 30 and has a damper 41, two sliding bases 42, a spring 43, two tracking assemblies 44 and two side frames 45.

The damper 41 has a cylinder 411 and a rod 412.

The rod 412 is mounted movably through the cylinder 411 axially. One of two ends of the rod 412 is mounted in one of two ends of the cylinder 411, and the other end of the rod 412 extends out of the cylinder 411.

Specifically, the damper 41 further has two attaching members 413. One of the attaching members 413 is mounted in the other end of the cylinder 411. The other attaching member 413 is mounted in the other end of the rod 412. The attaching member 413 has a square hole defined through the attaching member 413. The rod 412 has an outer thread that is formed in an outer surface of the other end of the rod 412. The other end of the rod 412 is mounted through the square hole of the attaching member 413, and the outer thread of the rod 412 is engaged with a nut by threading.

The sliding bases 42 are mounted rotatably in the two ends of the damper 41. Each sliding base 42 has an extending part 420, an embedding groove 421, multiple stubs 422, two sliding members 423 and a positioning groove 424. Specifically, one of the sliding bases 42 is mounted pivotably in the attaching member 413 in the other end of the cylinder 411. The other sliding base 42 is mounted pivotably in the attaching member 413 in the other end of the rod 412.

The extending part 420 is formed in a top end of the sliding base 42.

The embedding groove 421 is defined in the extending part 420 and is disposed detachably around the abutting part 211.

The multiple stubs 422 protrude symmetrically from two side surfaces of the sliding base 42 respectively. Specifically, two stubs 422 protrude symmetrically from each side surface of the sliding base 42.

The sliding members 423 protrude from the two side surfaces of the sliding base 42 respectively and are located beneath the stubs 422.

The positioning groove 424 is defined in the sliding base 42 and is disposed around the attaching member 413. The positioning groove 424 prevents the attaching member 413 from being pulled and disconnected from the sliding base 42.

Two ends of the spring 43 are mounted in the sliding bases 42 respectively.

The tracking assemblies 44 are disposed above the two ends of the damper 41. Each tracking assembly 44 has two tracking plates 440, two guiding grooves 441, two positioning parts 442, two shock-absorbing members 443 and an embedding groove 444.

The tracking plates 440 are disposed towards the damper 41 and the sliding base 42 respectively and are connected to each other. Each tracking plate 440 has an inner surface and an outer surface, and the inner surfaces of the tracking plates 440 are connected to each other.

The guiding grooves 441 are disposed around the stubs 422 of the sliding bases 42 and are connected to each other. Each guiding groove 441 is defined longitudinally in the inner surface of the tracking plate 440.

The positioning parts 442 are connected to each other. Each positioning part 442 is curved, is defined in one of two ends of the tracking plate 440, communicates with the guiding groove 441 and is located away from the damper 41.

The shock-absorbing members 443 are mounted in the inner surfaces of the tracking plates 440 respectively. Each shock-absorbing member 443 is disposed corresponding in position to the positioning part 442. The shock-absorbing members 443 are made of engineering plastic with high wear resistance and shock-absorbing ability.

The embedding groove 444 is defined longitudinally in the outer surface of the tracking plate 440.

The side frames 45 are mounted in the tracking assemblies 44 and are mounted in one of the roller carriers 30. Each side frame 45 is mounted in the outer surfaces of the tracking plates 440 and has a top extending tab 451, a protruding rib 452 and a bottom extending tab 453.

The top extending tab 451 protrudes from a top end of the side frame 45 and abuts a top end of the tracking plate 440.

The protruding rib 452 protrudes longitudinally from the side frame 45 and is mounted in the embedding groove 444.

The bottom extending tab 453 is formed longitudinally in a side surface of the side frame 45 and is located beneath the tracking plate 440. The bottom extending tab 453 and a bottom end of the tracking plate 440 limit the sliding member 423.

The two-way soft closing device of the present invention is mounted in an exit of a building, and a fixed door plate 51 and a sliding door plate 52 are mounted in the exit, as shown in FIG. 1. The fixed door plate 51 is mounted in one of two sides of the exit, and a passage is formed between the fixed door plate 51 and the other side of the exit. The sliding door plate 52 is mounted slidably in the other side of the exit and is side by side with the fixed door plate 51. The sliding door track 10 is mounted laterally in a top end of the exit. The hangers 33 of the roller carriers 30 that are mounted inside the sliding door track 10 are mounted firmly in the sliding door plate 52. When a user pushes or pulls the sliding door plate 52 along the sliding door track 10, the passage is opened for door-opening or is closed for door-closing. When the user adjusts a location of the soft closing activation trigger 20 relative to the sliding door track 10, a distance between the sliding door plate 52 and the doorframe is adjusted. A gap that is formed between the sliding door plate 52 and the doorframe is eliminated, and noise caused by the collision is avoided. The user removes the connecting member 23, and the top mounting plate 21 and the bottom mounting plate 22 are moved from the abutting rib 142. Since the bottom limiting rib 143 is located beneath the abutting rib 142, the connecting member 23 that is removed from the top mounting plate 21 and the bottom mounting plate 22 is supported by the bottom limiting rib 143 that prevents the bottom mounting plate 22 from falling to hit the user.

The rollers 32 are mounted rotatably in the supporting part 15 as shown in FIGS. 1 and 3. A length of the sliding door track 10 is less than a length of the exit. A length of the main sub-track 101 is one hundred and fifty centimeters (cm), and the maintenance sub-track 102 is sixty cm. When the user repairs the soft closing assembly 40, the maintenance sub-track 102 is removed from the track integration pins 16 and moved outwards longitudinally. Then, the soft closing assembly 40 is repaired, or components of the sliding door plate 52 are replaced. Since the track integration pins 16 connects the main sub-track 101 to the maintenance sub-track 102, the supporting part 15 of the main sub-track 101 and the supporting part 15 of the maintenance sub-track 102 are level with each other. Noise is avoided when the rollers 32 pass a junction of the main sub-track 101 and the maintenance sub-track 102. Furthermore, the level junction of the main sub-track 101 and the maintenance sub-track 102 prevents the rollers 32 from damaging in roundness, and the rollers 32 slide smoothly and stably between the main sub-track 101 and the maintenance sub-track 102.

With reference to FIG. 7, when the sliding door plate 52 is not opening or not closing, the stubs 422 of the sliding base 42 of the soft closing assembly 40 are embedded in the positioning parts 442 that are defined in the tracking plates 440 and communicate with the guiding grooves 441. Meanwhile, the spring 43 is stretched to accumulate resilience.

Figure 8:
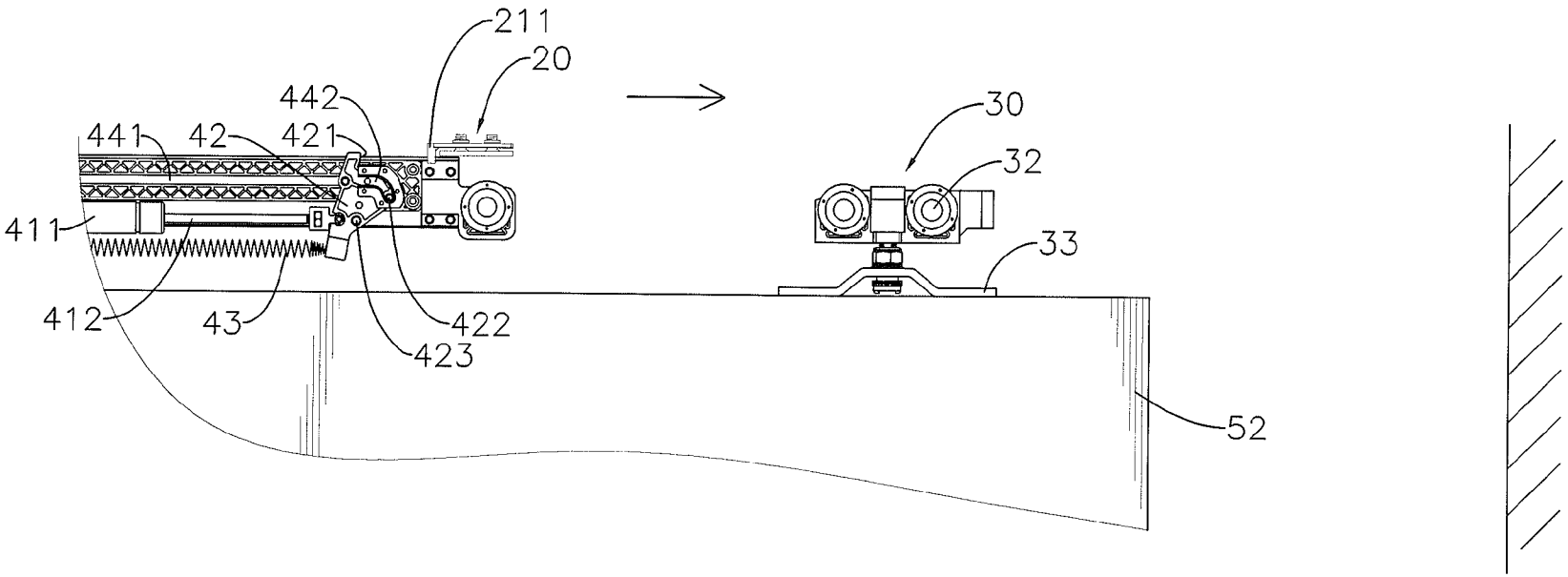
FIG. 8 is the first enlarged operational front view of the two-way soft closing device with partial elements in FIG. 1.

With reference to FIG. 8, when the user pushes the sliding door plate 52 to close the sliding door, the sliding door plate 52 drives the soft closing assembly 40 to move for closing the sliding door by the roller carriers 30.

Figure 9:
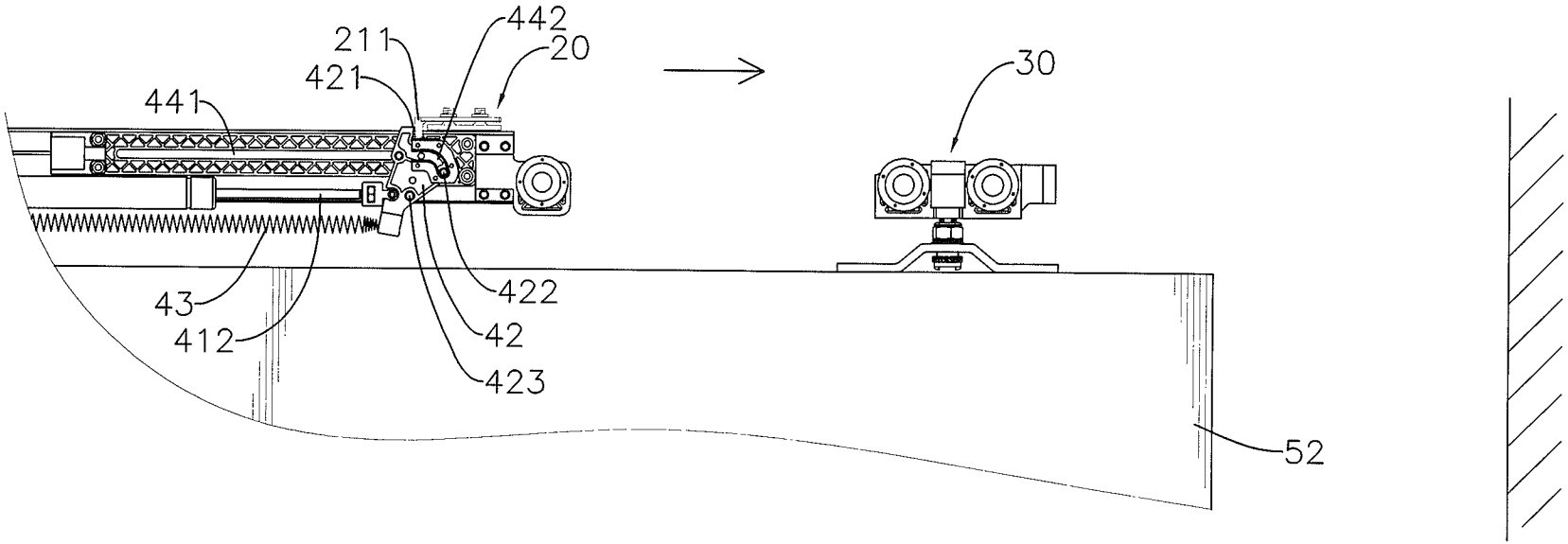
FIG. 9 is the second enlarged operational front view of the two-way soft closing device with partial elements in FIG. 1.

With reference to FIG. 9, when the sliding door plate 52, the roller carrier 30 and the soft closing assembly 40 move towards one of the soft closing activation triggers 20 that is located in a door-closing position, the abutting part 211 of the soft closing activation trigger 20 is embedded in the embedding groove 421 of the sliding base 42. As the sliding door plate 52 moves towards the door-closing position, the stubs 422 of the sliding base 42 that are driven by the abutting part 211 are removed from the positioning parts 442.

Figure 10:
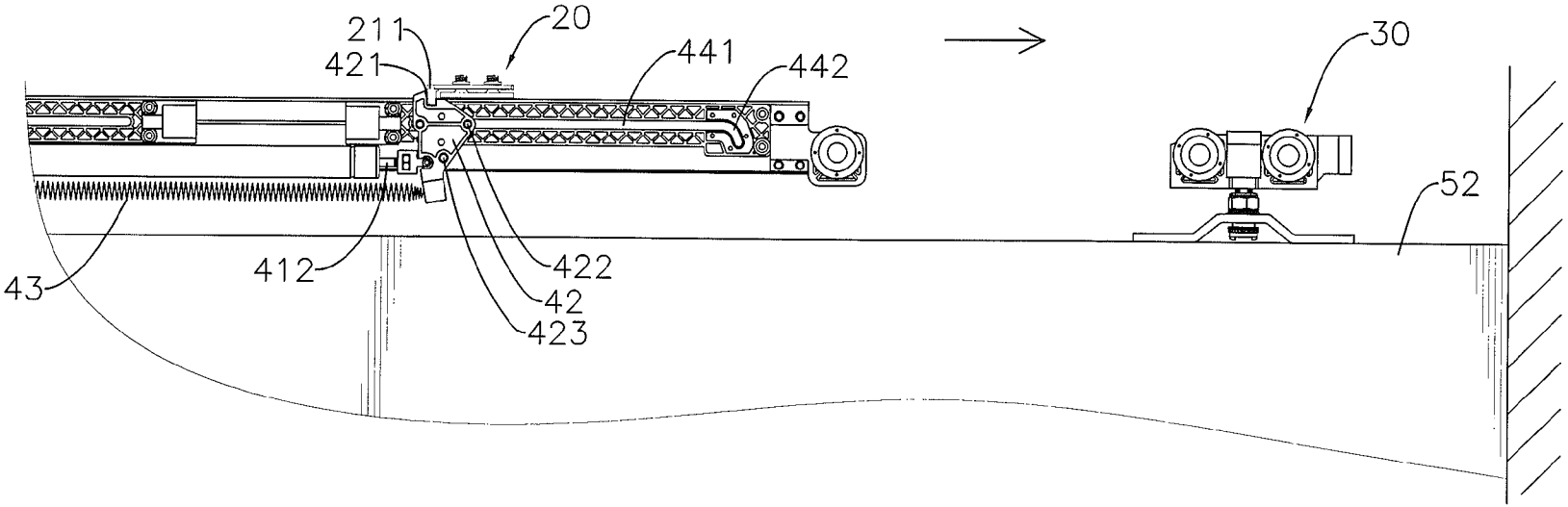
FIG. 10 is the third enlarged operational front view of the two-way soft closing device with partial elements in FIG. 1.

With reference to FIG. 10, after the stubs 422 are removed from the positioning parts 442, the resilience of the spring 43 drives the sliding door plate 52, the roller carrier 30 and the soft closing assembly 40 to move towards the door-closing position. Meanwhile, the damper 41 moderates a moving speed of the sliding door plate 52, the roller carrier 30, the tracking plate 440 and the side frame 45, and the sliding door plate 52 moves to the door-closing position slowly. Therefore, the two-way soft closing device of the present invention prevents an elder or a little child from being hit by the sliding door plate 52.

When the user pulls the sliding door plate 52 to move towards a door-opening position, the tracking plate 440 and the side frame 45 are driven by the roller carrier 30 to move along the sliding door track 10. Thus, the stub 422 of the sliding base 42 moves along the guiding groove 441 and is embedded in the positioning part 442. Meanwhile, the spring 43 is stretched to accumulate the resilience again.

The bottom extending tab 453 provides the side frame 45 with a strength and an endurance and works in coordination with the sliding member 423 that is disposed between the tracking plate 440 and the bottom extending tab 453, as shown in FIG. 6. The bottom extending tab 453 abuts the sliding member 423 to support the sliding base 42. Thus, the bottom extending tab 453 prevents the sliding base 42 from an external impact and makes the sliding base 42 slide smoothly and stably between the side frames 45.

The sliding member 423 is disposed between the bottom extending tab 453 of the side frame 45 and the tracking plate 440, so that an offsetting range of the sliding base 42 is limited, which prevents the soft closing assembly 40 from malfunction. When the user pulls the sliding door plate 52 with an excessive force that makes the sliding door plate 52 and the soft closing assembly 40 move at a high speed, the sliding base 42 collides with the abutting part 211. The sliding base 42 is pressed downwards and hits the tracking plate 440, and the soft closing assembly 40 is displaced and offset drastically, which makes the soft closing assembly 40 malfunction. Then, the sliding member 423 of one of the two side surfaces of the sliding base 42 abuts the bottom extending tab 453, and the sliding member 423 of the other side surface of the sliding base 42 abuts a bottom side of the tracking plate 440. Thus, the bottom extending tab 453 keeps a cushioning ability of the soft closing assembly 40 and prevents the soft closing assembly 40 from loosening.

The bottom surface of the top mounting plate 21 abuts the top surfaces of the abutting ribs 142 made of aluminum, and a top surface of the bottom mounting plate 22 abuts bottom surfaces of the abutting ribs 142. The top mounting plate 21 and the bottom mounting plate 22 enhance a clamping force for the abutting ribs 142. Thus, the top mounting plate 21 and the bottom mounting plate 22 prevent the soft closing activation trigger 20 from removal by the collision of the sliding door.

Figure 11:
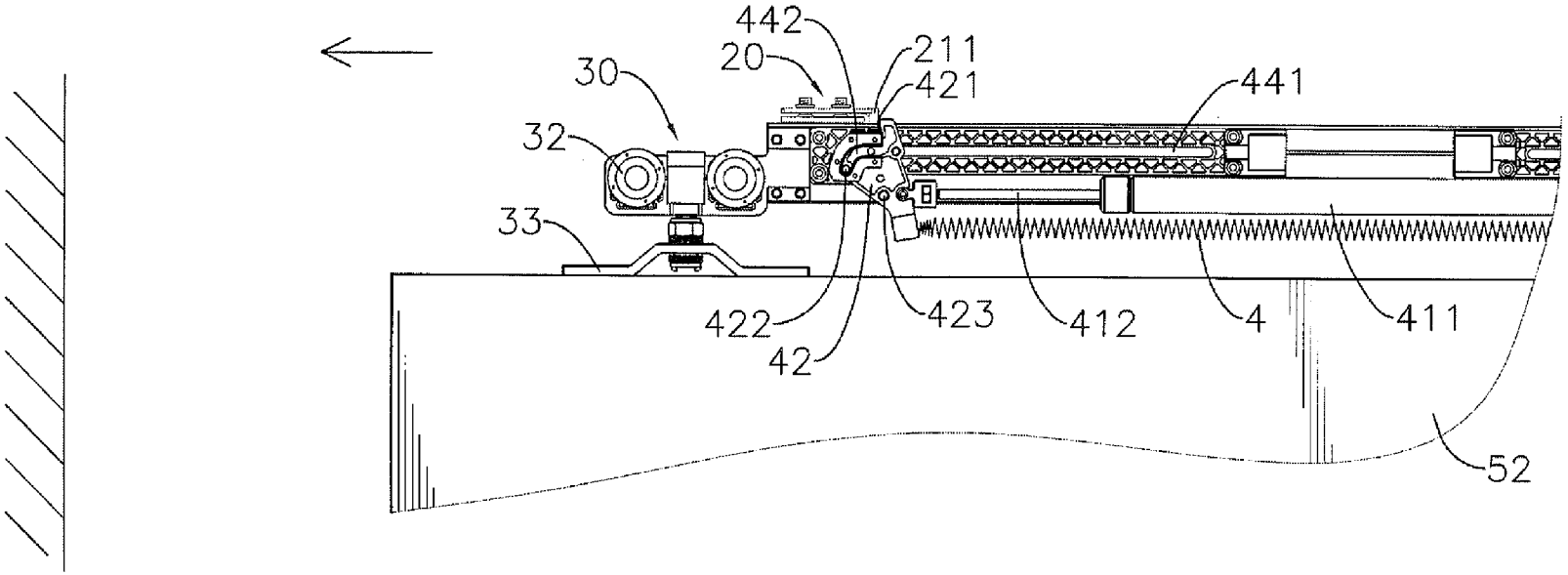
FIG. 11 is the fourth enlarged operational front view of the two-way soft closing device with partial elements in FIG. 1.

With reference to FIG. 11, as the sliding door plate 52, the roller carrier 30 and the soft closing activation trigger 20 move towards the door-opening position, the abutting part 211 of the soft closing activation trigger 20 that is located in the door-opening position is embedded in the embedding groove 421 of the sliding base 42. The stub 422 is removed from the positioning part 442. The resilience of the spring 43 drives the sliding door plate 52, the roller carrier 30, the tracking plate 440 and the side frame 45 to move towards the door-opening position. The damper 41 moderates the moving speed of the sliding door plate 52, the roller carrier 30, the tracking plate 440 and the side frame 45, and the sliding door plate 52 moves towards the door-opening position slowly to prevent the sliding door plate 52 from damage caused by collision between the sliding door plate 52 and the doorframe and to reduce the noise.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A two-way closing device comprising:

a sliding door track being an elongated member and having:

a top plate;

two side plates protruding from two sides of a bottom surface of the top plate;

a slot formed longitudinally in a bottom surface of the sliding door track and located between the two side plates;

two mounting parts disposed corresponding in position to each other, with the two mounting parts protruding from a top end of a side surface of the two side plates; and two supporting parts disposed corresponding in position to each other, with the two supporting parts protruding from a bottom end of the side surface of the two side plates;

two closing activation triggers mounted movably between the two mounting parts, mounted in two ends of the sliding door track respectively, with each closing activation trigger having a protruding abutting part;

two roller carriers mounted in the sliding door track, spaced apart at an interval, mounted through the slot, and mounted slidably in the two supporting parts; and a closing assembly mounted in the sliding door track, located between the two roller carriers, mounted in one of the two roller carriers, and having:

a damper;

two sliding bases mounted rotatably in two ends of the damper, with each sliding base having:

two side surfaces;

an extending part formed in a top end;

an embedding groove defined in the extending part and mounted detachably around the protruding abutting part of a corresponding closing activation trigger; and multiple stubs protruding symmetrically from the two side surfaces respectively;

a spring, with two ends of the spring mounted in the two sliding bases respectively;

two tracking assemblies disposed above the two ends of the damper, with each tracking assembly having:

two tracking plates disposed towards the damper and a corresponding sliding base respectively and connected to each other, with each tracking plate having an inner surface and an outer surface, with the inner surfaces of the two tracking plates connected to each other;

two guiding grooves disposed around the multiple stubs of the two sliding bases and connected to each other, with the two guiding groove grooves defined longitudinally in the inner surfaces of the two tracking plates; and two positioning parts connected to each other, with the positioning parts defined in one of two ends of the two tracking plates, communicating with the two guiding grooves, being curved, and located away from the damper; and two side frames mounted in the two tracking assemblies and mounted in one of the two roller carriers, with the two side frames mounted in the outer surfaces of the two tracking plates.

2. The two-way closing device as claimed in claim 1, wherein:

the damper has:

a cylinder; and a rod mounted movably through the cylinder axially, with one of two ends of the rod mounted in one of two ends of the cylinder, with another of the two ends of the rod extending out of the cylinder; and one of the two sliding bases mounted pivotably in another of the two ends of the cylinder, with another of the two sliding bases mounted pivotably in the one of the two ends of the rod.

3. The two-way closing device as claimed in claim 2, wherein:

each one of the two mounting parts has:

a top limiting rib protruding from a corresponding side plate;

an abutting rib protruding from the corresponding side plate and disposed corresponding in position to the top limiting rib at an interval;

a bottom limiting rib protruding from the corresponding side plate and disposed corresponding in position to the abutting rib at an interval;

a top mounting groove formed between the top limiting rib and the abutting rib; and a bottom mounting groove formed between the abutting rib and the bottom limiting rib;

each closing activation trigger has a top mounting plate, with two sides of the top mounting plate mounted respectively in the top mounting grooves of the two mounting parts, with the top mounting plate abutting the abutting rib and having:

a part formed in a bottom surface of the top mounting plate and abutting a top surface of the abutting rib; and at least one connecting hole defined through the top mounting plate;

each closing activation trigger has a bottom mounting plate, with two sides of the bottom mounting plate mounted respectively in the bottom mounting grooves of the two mounting parts, with the bottom mounting plate abutting the abutting rib and having:

at least one through hole defined through the bottom mounting plate and corresponding in position to the at least one connecting hole of the top mounting plate; and an abutting part protruding from the bottom surface of the top mounting plate, located between the abutting ribs of the two mounting parts, and extending over a bottom surface of the bottom mounting plate; and at least one connecting member mounted through the at least one through hole of the bottom mounting plate and mounted in the at least one connecting hole of the top mounting plate.

4. The two-way closing device as claimed in claim 3, wherein the sliding door track includes:

a main sub-track having the top plate, the two side plates, the slot, the two mounting parts protruding from the two side plates respectively, and the two supporting parts protruding from the two side plates respectively, wherein each mounting part further has a top inserting groove defined longitudinally in the mounting part, and wherein each supporting part has a bottom inserting groove defined longitudinally in the supporting part;

a maintenance sub-track having the top plate, the two side plates, the slot, the two mounting parts protruding from the two side plates, and the two supporting parts protruding from the two side plates respectively, wherein each mounting part has the top inserting groove, and wherein each supporting part has the bottom inserting groove; and four track integration pins connecting the main sub-track to the maintenance sub-track and disposed in parallel to each other, wherein each track integration pin has a first end and a second end, with the first ends of the four track integration pins mounted respectively in the top inserting groove and the bottom inserting groove of the main sub-track, and with the second ends of the four track integration pins mounted respectively in the top inserting groove and the bottom inserting groove of the maintenance sub-track; and wherein the two closing activation triggers are mounted in the main sub-track and the maintenance sub-track respectively.

5. The two-way closing device as claimed in claim 4, wherein:

each one of the two sliding bases of the closing assembly further has two sliding members protruding from two side surfaces of the sliding base respectively; and each one of the two side frames has a bottom extending tab located beneath the tracking plate and formed longitudinally in a side surface of the side frame, wherein the bottom extending tabs of the two side frames and bottom ends of the two tracking plates limit the sliding member.

6. The two-way closing device as claimed in claim 5, wherein:

each one of the two tracking assemblies has an embedding groove defined longitudinally in the outer surface of the tracking plate; and each one of the two side frames further has a protruding rib protruding longitudinally from the side frame and mounted in the embedding groove.

7. The two-way closing device as claimed in claim 6, wherein each one of the roller carriers has:

a base part;

multiple rollers mounted rotatably in two side surfaces of the base part in pairs and mounted slidably in the two supporting parts of the sliding door track; and a hanger extending out of the slot of the sliding door track and mounted in a bottom of the base part.

8. The two-way closing device as claimed in claim 7, wherein each one of the two tracking assemblies has two shock-absorbing members mounted in the inner surfaces of the two tracking plates respectively, with each shock-absorbing member disposed corresponding in position to a corresponding positioning part.

9. The two-way closing device as claimed in claim 8, wherein the part of the top mounting plate has multiple projections protruding from the top mounting plate and abutting the abutting ribs of the two mounting parts.

10. The two-way closing device as claimed in claim 1, wherein:

each one of the two mounting parts has:

a top limiting rib protruding from a corresponding side plate;

an abutting rib protruding from the corresponding side plate and disposed corresponding in position to the top limiting rib at an interval;

a bottom limiting rib protruding from the corresponding side plate and disposed corresponding in position to the abutting rib at an interval;

a top mounting groove fointed between the top limiting rib and the abutting rib; and a bottom mounting groove formed between the abutting rib and the bottom limiting rib;

each closing activation trigger has a top mounting plate, with two sides of the top mounting plate mounted respectively in the top mounting grooves of the two mounting parts, with the top mounting plate abutting the abutting rib and having:

a part formed in a bottom surface of the top mounting plate and abutting a top surface of the abutting rib; and at least one connecting hole defined through the top mounting plate;

each closing activation trigger has a bottom mounting plate, with two sides of the bottom mounting plate mounted respectively in the bottom mounting grooves of the two mounting parts, with the bottom mounting plate abutting the abutting ribs and having:

at least one through hole defined through the bottom mounting plate and corresponding in position to the at least one connecting hole of the top mounting plate;

an abutting part protruding from the bottom surface of the top mounting plate located between the abutting ribs of the two mounting parts, and extending over a bottom surface of the bottom mounting plate; and at least one connecting member mounted through the at least one through hole of the bottom mounting plate and mounted in the at least one connecting hole of the top mounting plate.

11. The two-way closing device as claimed in claim 10, wherein the sliding door track includes:

a main sub-track having the top plate, the two side plates, the slot, the two mounting parts protruding from the two side plates respectively, and the two supporting parts protruding from the two side plates respectively, wherein each mounting part further has a top inserting groove defined longitudinally in the mounting part, and wherein each supporting part has a bottom inserting groove defined longitudinally in the supporting part;

a maintenance sub-track having the top plate, the two side plates, the slot, the two mounting parts protruding from the two side plates respectively, and the two supporting parts protruding from the two side plates respectively, wherein each mounting part has the top inserting groove, and wherein each supporting part has the bottom inserting groove; and four track integration pins connecting the main sub-track to the maintenance sub-track and disposed in parallel to each other, wherein each track integration pin has a first end and a second end, with the first ends of the four track integration pins mounted respectively in the top inserting groove and the bottom inserting groove of the main sub-track, and with the second ends of the four track integration pins mounted respectively in the top inserting groove and the bottom inserting groove of the maintenance sub-track; and wherein the two closing activation triggers are mounted in the main sub-track and the maintenance sub-track respectively.

12. The two-way closing device as claimed in claim 11, wherein:

each one of the two sliding bases of the soft closing assembly further has two sliding members protruding from two side surfaces of the sliding base respectively; and each one of the two side frames has a bottom extending tab located beneath the tracking plate and formed longitudinally in a side surface of the side frame, wherein the bottom extending tabs of the two side frames and bottom ends of the two tracking plates limit the sliding member.

13. The two-way closing device as claimed in claim 12, wherein:

each one of the two tracking assemblies has an embedding groove defined longitudinally in the outer surface of the tracking plate; and each one of the two side frames further has a protruding rib protruding longitudinally from the side frame and mounted in the embedding groove.

14. The two-way closing device as claimed in claim 13, wherein each one of the roller carriers has:

a base part;

multiple rollers mounted rotatably in two side surfaces of the base part in pairs and mounted slidably in the two supporting parts of the sliding door track; and a hanger extending out of the slot of the sliding door track and mounted in a bottom of the base part.

15. The two-way closing device as claimed in claim 14, wherein each one of the two tracking assemblies has two shock-absorbing members mounted in the inner surfaces of the two tracking plates respectively, with each shock-absorbing member disposed corresponding in position to a corresponding positioning part; and the part of the top mounting plate has multiple projections protruding from the top mounting plate and abutting the abutting ribs of the two mounting posts.

16. A closing activation trigger assembly of a two-way closing device comprising:

a sliding door track being an elongated member and having:

a top plate;

two side plates protruding from two sides of a bottom surface of the top plate;

two mounting parts connected to each other and protruding from a top end of a side surface of the two side plates, with each mounting part having:

a top limiting rib protruding from a corresponding side plate;

an abutting rib protruding from the corresponding side plate and disposed corresponding in position to the top limiting rib at an interval;

a bottom limiting rib protruding from the corresponding side plate and disposed corresponding in position to the abutting rib at an interval;

a top mounting groove formed between the top limiting rib and the abutting rib; and a bottom mounting groove formed between the abutting rib and the bottom limiting rib; and two supporting parts connected to each other and protruding from a bottom end of the side surfaces of the two side plates; and two closing activation triggers mounted movably between the two mounting parts, mounted in two ends of the sliding door track respectively, with each closing activation trigger having:

a top mounting plate, with two sides of the top mounting plate mounted respectively in the top mounting grooves of the two mounting parts, with the top mounting plate abutting the abutting rib and having:

an abutting part located between the abutting ribs of the two mounting parts and protruding from a bottom surface of the top mounting plate; and at least one connecting hole defined through the top mounting plate;

a bottom mounting plate, with two sides of the bottom mounting plate mounted respectively in the bottom mounting grooves of the two mounting parts, with the bottom mounting plate abutting the abutting rib and having:

at least one through hole defined through the bottom mounting plate and corresponding in position to the at least one connecting hole of the top mounting plate, wherein a bottom surface of the bottom mounting plate is extended over by the abutting part of the top mounting plate; and at least one connecting member mounted through the at least one through hole of the bottom mounting plate and mounted in the at least one connecting hole of the top mounting plate.

17. The closing activation trigger assembly of a two-way closing device as claimed in claim 16, wherein the top mounting plate has a part formed in the bottom surface of the top mounting plate and abutting top surfaces of the abutting ribs.

18. The closing activation trigger assembly of a two-way closing device as claimed in claim 17, wherein the part of the top mounting plate has multiple projections protruding from the top mounting plate and abutting the abutting ribs of the two mounting parts.

19. The closing activation trigger assembly of a two-way closing device as claimed in claim 18, wherein the sliding door track includes:

a main sub-track having the top plate, the two side plates, the slot, the two mounting parts protruding from the two side plates respectively, and the two supporting parts protruding from the two side plates respectively, wherein each mounting part further has a top inserting groove defined longitudinally in the mounting part, and wherein each supporting part has a bottom inserting groove defined longitudinally in the supporting part;

a maintenance sub-track having the top plate, the two side plates, the slot, the two mounting parts protruding from the two side plates, and the two supporting parts protruding from the two side plates respectively, wherein each mounting part has the top inserting groove, and wherein each supporting part has the bottom inserting groove; and four track integration pins connecting the main sub-track to the maintenance sub-track and disposed in parallel to each other, wherein each track integration pin has a first end and a second end, with the first ends of the four track integration pins mounted respectively in the top inserting groove and the bottom inserting groove of the main sub-track, and with the second ends of the four track integration pins mounted respectively in the top inserting groove and the bottom inserting groove of the maintenance sub-track.

* * * * *